US007559408B2

(12) United States Patent
Flynn et al.

(10) Patent No.: US 7,559,408 B2
(45) Date of Patent: Jul. 14, 2009

(54) CORRELATING SOUNDS TO ELEVATORS SERVING DESTINATION FLOORS

(75) Inventors: Michael P. Flynn, Avon, CT (US); Vlad Zaharia, Rocky Hill, CT (US)

(73) Assignee: Otis Elevator Company, Farmington, CT (US)

( * ) Notice: Subject to any disclaimer, the term of this patent is extended or adjusted under 35 U.S.C. 154(b) by 504 days.

(21) Appl. No.: 10/588,684

(22) PCT Filed: May 19, 2004

(86) PCT No.: PCT/US2004/015788

§ 371 (c)(1),
(2), (4) Date: Aug. 8, 2006

(87) PCT Pub. No.: WO2005/118450

PCT Pub. Date: Dec. 15, 2005

(65) Prior Publication Data

US 2007/0181379 A1 Aug. 9, 2007

(51) Int. Cl.
*B66B 1/34* (2006.01)

(52) U.S. Cl. ..... 187/396; 187/391; 187/901

(58) Field of Classification Search ..... 187/247, 187/380–388, 391–396, 901; 701/209, 211
See application file for complete search history.

(56) References Cited

U.S. PATENT DOCUMENTS 4,400,787 A 8/1983 Mandel et al.
5,551,533 A 9/1996 Ng
5,806,017 A * 9/1998 Hancock ..... 701/209
6,021,870 A 2/2000 Kim
6,394,231 B1 * 5/2002 Schuster et al. ..... 187/382
6,696,926 B2 2/2004 Tsukamoto et al.
6,902,041 B2 * 6/2005 Eccleston ..... 187/380
2001/0035314 A1 * 11/2001 Yoshida et al. ..... 187/382
2004/0000453 A1 1/2004 Eccleston

OTHER PUBLICATIONS

PCT International Search Report for PCT/US2004/015788, dated Dec. 10, 2004.
PCT International Preliminary Examination Report for PCT/US2004/015788, dated Dec. 8, 2005.
PCT Written Opinion for PCT/US2004/015788, dated Dec. 10, 2004.

* cited by examiner

*Primary Examiner*—Jonathan Salata

(57) ABSTRACT

A floor selection station (39*a*) has at least one switch button (45-51, 70, 93) which visually handicapped people use in selecting floors, and a speaker (54) to emit a sound uniquely ndicative of which elevator to board. Stations (39*a*, 39*c*) have a plurality of buttons with Braille indications of groups of floors (45-51) or individual floors (33). A station (39*b*) has only one button (70). Near or at each elevator lobby related to a group of floors serving a building, a floor identifier (39, 42) identifies with color, and optionally a symbol such as letter, each floor which is served by the group of elevators related to that lobby. At each elevator (26-29) there is an elevator indicator (32-35) which displays the same color, and optionally the same symbol, as displayed for any floor which the respective elevator is currently assigned to serve, and a speaker (32*a* 35*a*) which emits the same sound as at the floor selection station until the assigned elevator is dispatched.

4 Claims, 4 Drawing Sheets

CORRELATING SOUNDS TO ELEVATORS SERVING DESTINATION FLOORS

TECHNICAL FIELD

This invention relates to assisting vision impaired persons, by identifying with distinctive sounds which elevator is to serve one or more contiguous floors, which may also assist persons that are color blind in locating elevators identified with colors and/or symbols.

BACKGROUND ART

A wide variety of techniques for interfacing passengers with suitable elevators are known in the art. One class of devices call an elevator to a floor to pick up a passenger. This class of devices may be as simple as the well-known up/down call buttons. More recent call destination systems might display a large number of floor buttons or might consist of ten key destination floor call devices. Still other devices include card readers as well as hand-held call devices and smart badges which operate in a wireless fashion, such as using electromagnetic radiation (RF, IR), to indicate the desire to be picked up on a certain floor, the desired destination floor, and possibly the security access for the destination floor.

To inform passengers which elevators will serve them, the technique might be as simple as up/down directional lanterns which light as an elevator approaches a floor, or which light immediately (or fairly soon) after a call is placed. For remote call devices and certain of the destination call devices, an indication may appear on the device itself, such indication typically comprising a letter indicative of the elevator which will respond to that call.

During morning rush hour, up peak elevator traffic may be handled without any call devices in the simplest of techniques, passengers simply walking in and observing on a panel above the elevator the floor numbers of the group of floors being served by any particular elevator which is, or is about to be, standing at the landing. An example of such a system is disclosed in U.S. Pat. No. 4,804,069, entitled "Contiguous Floor Channeling Elevator Dispatching". The problem with these devices is that they can only be observed within a relatively small area in the immediate vicinity of each elevator, so passengers must hunt for the elevator assigned to a group of floors that includes the destination floor of the passenger. This tends to cause milling around and confusion, which is counterproductive to a smooth upflow of passengers.

A preferred manner of handling morning rush hour, up peak elevator traffic is sometimes referred to as "channeling", as is disclosed in the aforementioned U.S. Pat. No. 4,804,069 and in U.S. Pat. No. 4,846,311, entitled "Optimized 'Up-Peak' Elevator Channeling System with Predicted Traffic Volume Equalized Sector Assignments". Therein, during the morning rush, floors are assigned to various groupings called "sectors". In the latter case, the assignment of floors to sectors is altered as the predicted volume of traffic to particular floors changes, in small time intervals (every few minutes), so that a floor may be served with the floors above it on one trip and be served with the floors below it on the next trip. Furthermore, although a given sector, for instance the highest sector in the building, may be relatively stable so that the person on the highest floor can depend upon it being the highest sector, nonetheless that sector may be assigned to a different elevator each time the trip is made. Assigning sectors to different elevators is one of the ways that traffic flow is increased. This of course makes it more difficult for passengers to determine which elevator to take.

In systems having destination call panels, it has been known to provide, typically by means of a letter, the indication of the elevator, which is to serve a group of floors including the floor of the destination, which has just been entered on the call device. However, the use of the destination call device itself slows down the flow of rush hour traffic, and the letters do not themselves provide the best correlation, particularly in view of the fact that the building tenants must remember the letter from some place in a corridor well in advance of the elevator lobby, and typically being a different letter every day.

In PCT publication WO 01/79101, a sector including a passenger's destination floor is identified with a color, and the elevator serving that floor at that time is identified with the same color, in a manner, which is readily observed from any entrance to or any position within a corresponding elevator lobby.

Although color assignment to sectors is a very effective way to serve up-peak traffic during morning rush hour for persons who are able to see colors, it is of no use to persons who are significantly vision-impaired. Use of symbols (such as alphabetic letters) will accommodate persons who have sight but are color blind; however, symbols will not accommodate those who are essentially un-sighted.

DISCLOSURE OF INVENTION

Objects of the invention include: improvements in serving visually impaired persons during rush hour, up peak elevator traffic; non-visual correlation between desired destination floor and elevator serving that floor; an easily rememberable correlation between destination floor and elevator serving such floor; and smooth passenger service for visually impaired persons in an elevator system employing variable assignments of elevators to sectors.

According to the present invention, a station in a lobby hallway has buttons which are pressed to identify a destination floor or a range of floors including a destination floor; as soon as the elevator that will answer the call has been determined, the station issues a unique sound, such as a tone or series of tones, the sound corresponding to each elevator being readily distinguishable from the sound corresponding to any other elevator. Once a sound is emitted at the hall station, the sound is also emitted at the elevator, which is serving the request indicated by the button until the elevator leaves the landing.

In one embodiment of the invention, the sectors (groups of floors) that are served during up peak are fixed, and therefore only the range of floors served in each corresponding sector need appear in Braille on the respective buttons. In other embodiments, an N-key service request panel can be marked in Braille for each floor of the building, the sector in which the floor is currently assigned being identified by a unique sound when a floor button is pressed.

In either embodiment, the visually handicapped passenger will locate either the group of floors containing the floor of desired destination, or the destination floor itself, by touching buttons identified with Braille, to determine a car, which will carry the passenger to his/her desired destination.

An optional feature of the invention is to color sector buttons to match the fixed sector assignments of floors in the building so that sighted persons may if they wish press the sector button to hear the sound leading them to the correct elevator.

In any of the above embodiments, each sound may be permanently assigned to a respective car, or each sound may be permanently assigned to a respective sector.

Although the N-key embodiment of the invention works for off peak as well as up peak, the visually handicapped will normally use the conventional up/down hall call buttons to request service, and locate the responding car by the sound of the gong.

In another embodiment of the invention, a single button may be used for the visually handicapped. Upon pressing the button, a list of floors within sectors is announced. When the destination floor is announced, pressing of the button by the passenger will cause that sector to be identified, producing a unique sound, which sound is repeated at the elevator assigned to that sector.

Other objects, features and advantages of the present invention will become more apparent in the light of the following detailed description of exemplary embodiments thereof, as illustrated in the accompanying drawing.

MODE(s) FOR CARRYING OUT THE INVENTION

Figure 1:
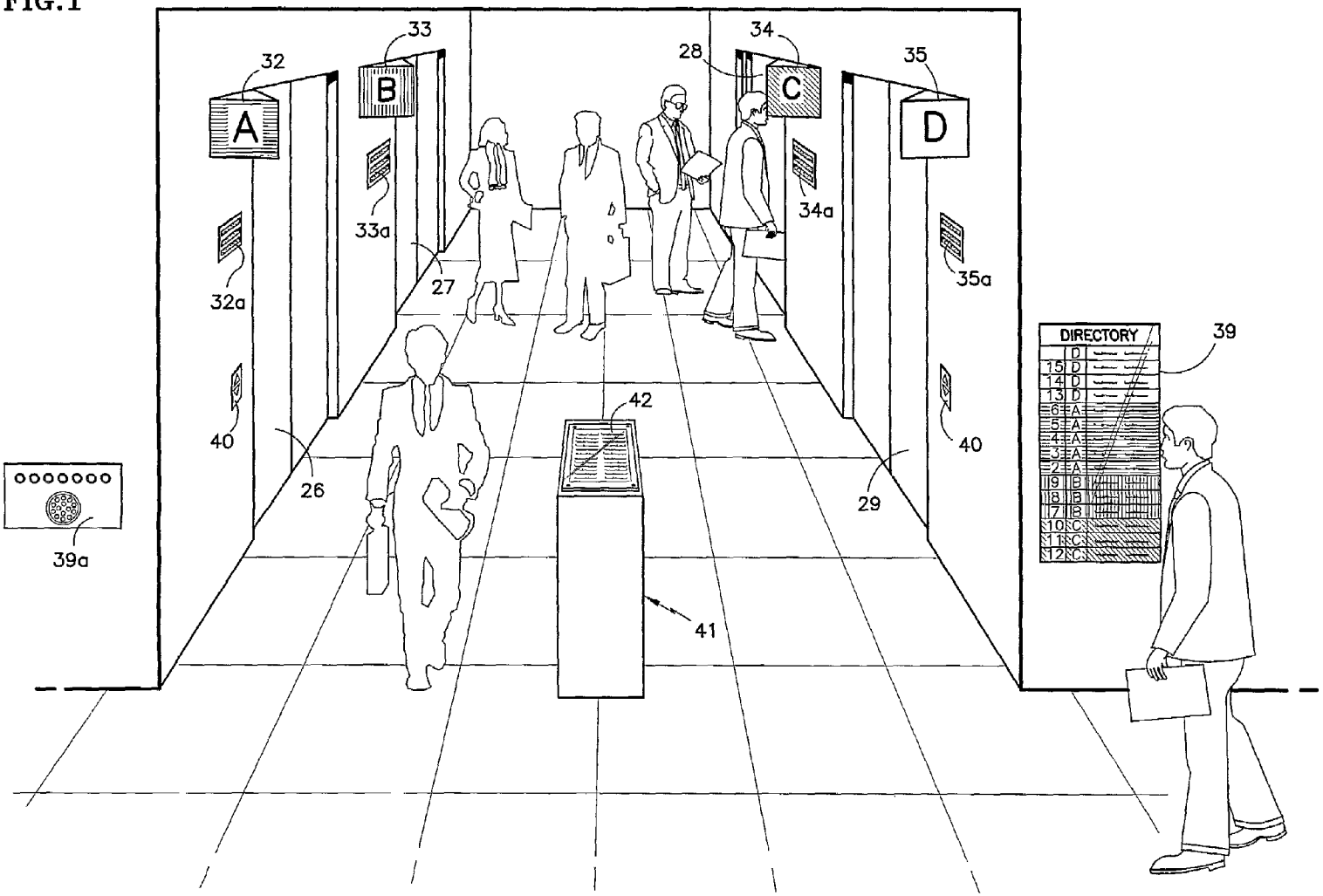
FIG. 1 is a simplified perspective view of an elevator lobby having: a hallway floor indicator panel identifying groups of floors to be served by various elevators during rush hour up peak elevator traffic; a kiosk to identify tenants by means of which one or more floors relating to a tenant can be identified and calls entered as potential destination floors; and elevator indicators, indicating by color (as well as symbols) the otherwise identified destination floors which are to be serviced by the elevator.

In FIG. 1, an elevator lobby includes a plurality of elevators 26-29, each having an elevator car indicator 32-35 and an elevator car identifier, such as an electronic speaker 32*a*-35*a* disposed adjacent thereto. Each indicator is capable of displaying a color (the difference in colors being indicated by cross hatching) and a symbol, such as a letter or other symbol. The speakers could be incorporated into the car indicators 32-35, if desired. In any given implementation of the present invention, the symbol may be letters such as those illustrated in FIG. 1, or they may be some other type of symbol which has an easily-rememberable impression, such as geometrical shapes, flowers vs. lightning bolts or any other differentiating and easily remembered set of symbols. For instance, elevator indicator 32 may be displaying the letter A and the color blue. Elevator indicator 33 may be displaying the letter B and the color red, elevator indicator 34 may be displaying the letter C and the color green, elevator indicator 35 may be yellow, with the letter D.

Tones will emanate from the speakers only when service has been requested from a visually handicapped person. The indicator 35 may be yellow, but it is not currently lit and is displaying no color since it is not assigned to any sector of floors for its next trip, at the particular moment; or elevator 29 may be assigned to interfloor traffic, which is common in systems employing channeling; there would also be no tone emanating from the annunciator 35*a*.

In a hallway leading to the elevator lobby, there is disposed a floor indicator panel 39 for the sighted, and a station 39*a* for the visually handicapped. All of the floors served by the group at the elevator lobby are indicated on the panel 39, either simply by floor number, or perhaps by floor number and principal tenants. The important thing is, however, that groups of floors being served by an elevator are identified with the same color displayed by the elevator indicators 32-35 and the same tone from the speakers 32*a*-35*a* corresponding to the respective elevator currently assigned to serve the related group of floors. Conventional hall call buttons 40 are used during off peak.

In one embodiment, each floor is permanently assigned to a sector and each sector has a color and a tone permanently assigned to it. In such case, sighted building tenants need not look at the floor identifier panel during morning up peak; tenants need only look to see which elevator (if any) is displaying their regular, every-day color. However, sounds may be less easily remembered, so the visually handicapped may press the desired sector button each day.

In the case of dynamic channeling, the channeling dispatcher continuously makes new floor groupings to form sectors of contiguous floors; some floors may be assigned to a new sector, and their colors in the panel 39 and their tone will therefore change. The color of a floor in the panel 39 and the tone in the speakers 32*a*-35*a* will not change from the time the elevator car is assigned until the assigned car has left on a trip. Then any floor in the sector being served may be transferred to a contiguous sector and the color of that floor on the panel 39 and the speaker sound will change to the color and sound of the new sector, when it is assigned to a car. The coloration of floors in the panel 39, and the corresponding letters (A/blue; B/red, C/green; D/yellow) as well as the speaker sounds will therefor reflect the sector assignment of each floor, as the assignments of some floors are moved into other sectors, as the rush hour progresses.

In FIG. 1, elevators A and B are at upper floors, either delivering passengers to their destinations, or returning toward the lobby. These elevators have, however, been assigned to groups of floors, elevator A having been assigned to the sector including floors 2-6 and elevator B having been assigned floors 7-9. Elevator C, assigned to floors 10-12, is currently boarding passengers.

In FIG. 1, a kiosk 41 may contain a tenant list 42. Although not shown, for clarity, the tenant list has colors to identify elevators assigned to serve various tenant floors, with corresponding buttons for selecting the desired floor.

Figure 2:
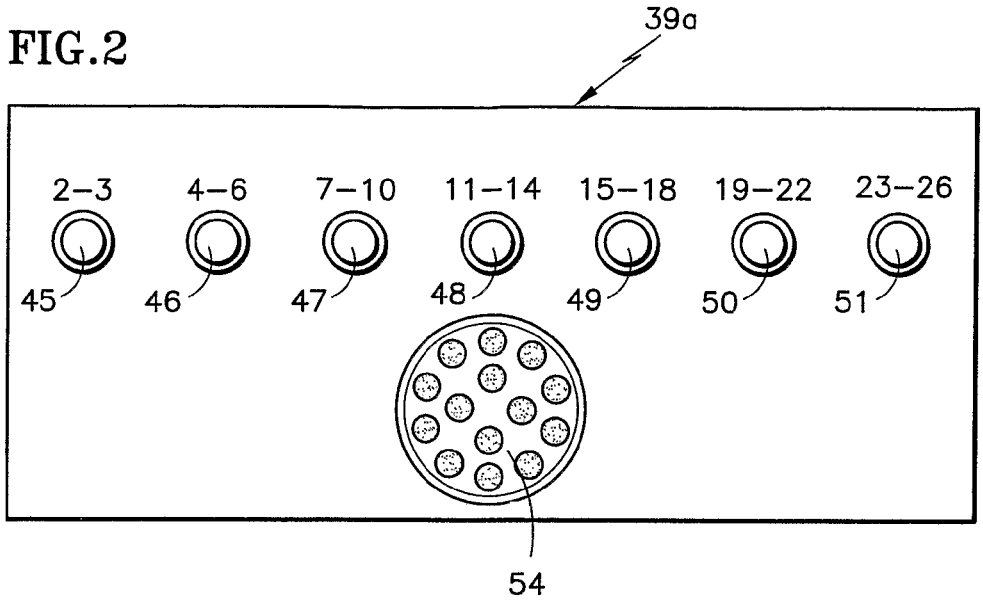
FIG. 2 is a front elevation view of a first embodiment of an elevator floor selection station of the invention.

Referring to FIG. 2, the station 39*a* for the visually handicapped, illustrated in FIG. 1, comprises a plurality of Braille selection buttons 45-51 each of which indicates in Braille (although not shown in FIG. 2 for clarity) a grouping of floors which are within fixed sector assignments. As indicated above each of the buttons 45-51, button 45 designates a sector including floors 2-5, and button 51 designates a sector including floors 23-26; and the other buttons similarly designate sectors of groups of floors. In the station 39*a*, there is an electronic speaker 54 which will emit a sound such as a tone, or a sound comprising a mixture of tones, which is unique for each of the buttons 45-51. The sounds are sufficiently distinguishable so that a visually handicapped person will recognize each sound in contrast to each other sound when seeking an elevator adjacent to a corresponding one of the speakers 32*a*-35*a* (FIG. 1).

Figure 3:
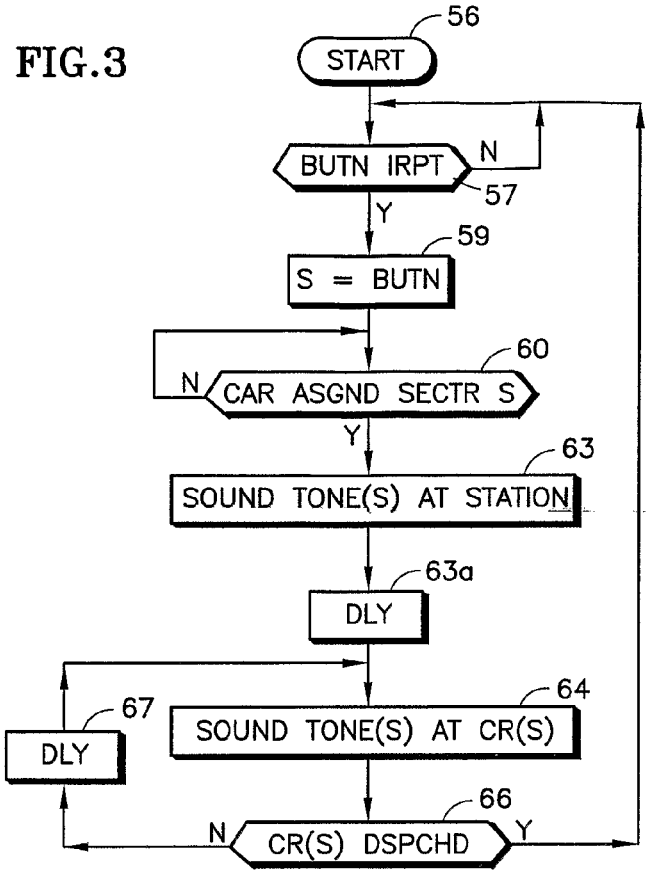
FIG. 3 is a simplified flow chart of functions which may be performed in utilization of the embodiment of FIG. 2.

An illustration of the functions which might be performed with the embodiment of FIG. 2 is shown in FIG. 3. The routine may start at a point 56 and a first test 57 determines if there is a button interrupt, which will occur when any of the buttons 45-51 is pressed. If not, the routine cycles around a negative result of test 57. When a button is pressed, a step 59 sets a sector indicator, S, equal to the sector of the button which in fact was pressed. Then, a test 60 determines if a car is assigned to sector S at this point in time; if not, the routine cycles around a negative result of test 60. When a car is assigned to sector S, the step 63 sounds a tone herein defined to include a series of tones or other sounds in speaker 54 (FIG. 2) indicating sector S at the station. After a short delay at step 63*a*, a step 64 sounds the same tone indicating sector S at the car assigned to sector S (one of the speakers 32*a*-35*a* of FIG. 1).

Then a test 66 determines if the car assigned to sector S has been dispatched or not; if not, the routine will wait for a small period of time as established by a delay 67, such as ten seconds or such other time as is determined to be appropriate, and step 64 will again sound the tone indicative of sector S at the car assigned to sector S. This continues until the car assigned to sector S is dispatched, at which time an affirmative result of test 66 causes the routine to revert to the test 57 to await another button interrupt.

Optionally, in a parallel processing computer, there may be several routines such as FIG. 3, and a rotating selection of them, so that additional passengers may select destination floor sectors while one or more passengers are waiting for their cars to be assigned and/or to be dispatched. An alternative to FIG. 3 is to have a routine substantially identical to FIG. 3 for each of the buttons in which case the step 59 can be omitted, and the sector S will automatically be designated as that sector corresponding to the separate routine.

Figure 4:
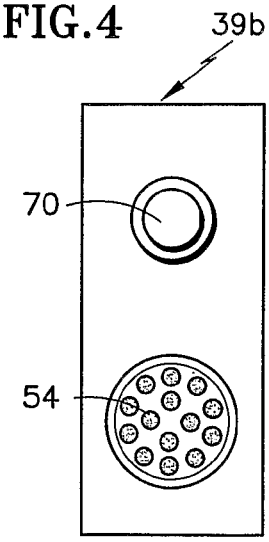
FIG. 4 is a front elevation view of a second embodiment of an elevator floor selection station of the invention.
Figure 5:
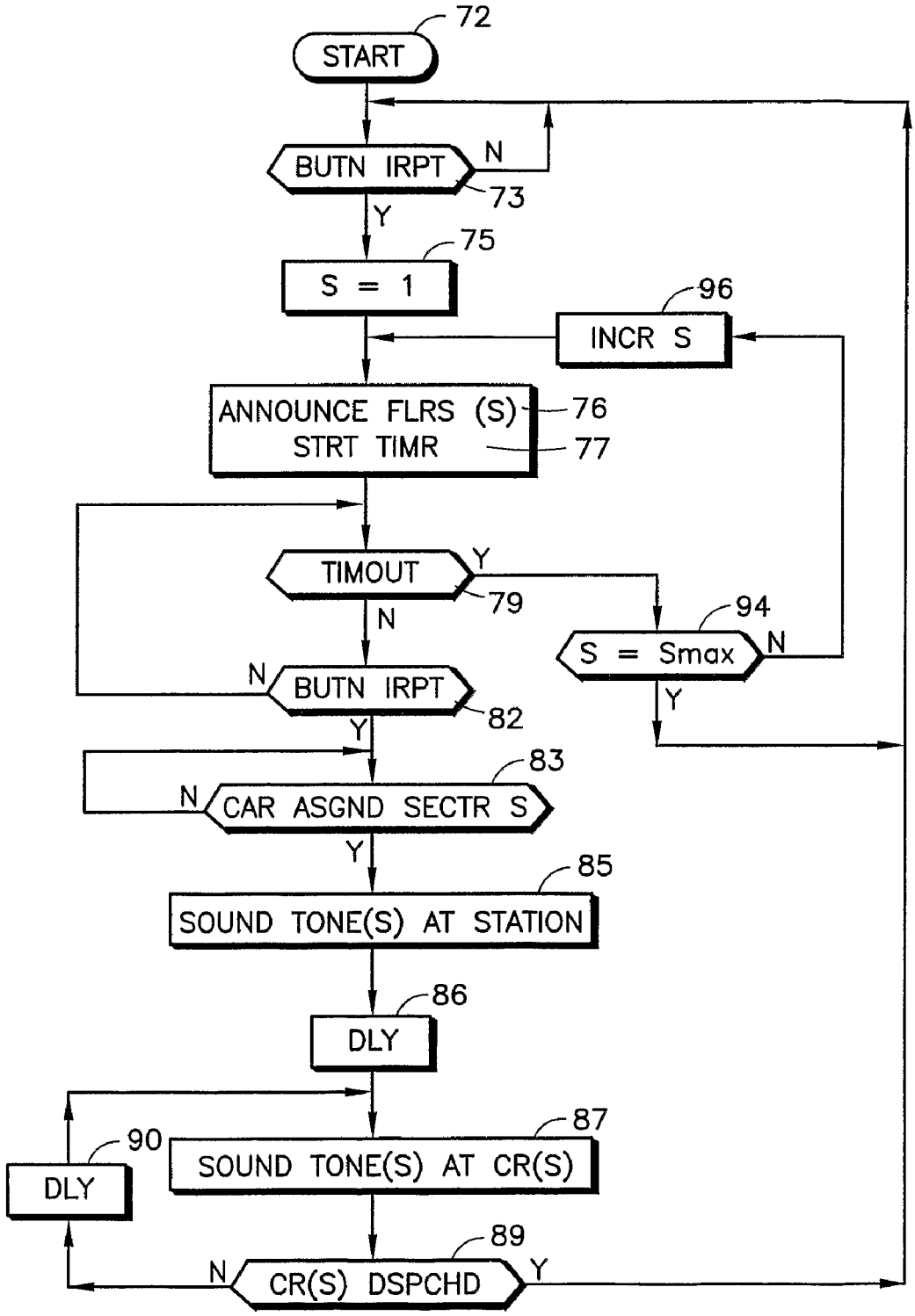
FIG. 5 is a simplified flow chart of functions which may be performed in utilization of the embodiment of FIG. 4.

Another embodiment of the invention, illustrated in FIG. 4, is a station 39*b* which has only a single button 70. Referring to FIG. 5, a routine corresponding to the embodiment of FIG. 4 may start at a point 72 and a first step 73 determines if there is a button interrupt. When there is, a step 75 sets a sector indicator, S, to one and then announces the first and last floors within sector one through the speaker 54 (FIG. 4). Then a timer is started in a step 77, and a test 79 determines if the timer has timed out or not. Initially, it will not have timed out so a test 82 determines if there is another button interrupt or not. This will occur when the potential passenger hears the ranges of floors which is inclusive of the passenger's desired destination floor.

When the passenger hears the desired range of floors, the passenger will again press the button 70 causing the test 82 to be affirmative reaching a test 83 to determine if a car has been assigned to the sector related to the floor range announced just before the passenger pressed the button 70 again. If not, the routine will cycle on a negative result of test 83.

When a car has been assigned, an affirmative result of test 83 reaches a step 85 to sound the tone relating to sector S at the station (speaker 54, FIG. 4). After a short delay at step 86, a step 87 causes the tone related to sector S to be sounded at the car assigned to sector S (through one of the speakers 32*a*-35*a*, FIG. 1).

A test 89 determines if the car assigned to sector S is dispatched yet or not. If not, the routine will wait for a delay 90 and then the step 87 will again cause the tone for sector S to be sounded at the car assigned to sector S. Once the car has been dispatched, an affirmative result of test 89 causes the routine to revert to the step 73 to await an additional button interrupt.

If the passenger has not pressed a button selecting a sector by the time that the timer times out, an affirmative result of test 79 will reach a test 94 to see if all of the sectors have been announced. If not, a step 96 increments S and another sector is announced. When all sectors have been announced, an affirmative result of test 94 reverts the routine to test 73, to await another button interrupt. Alternatively, an affirmative result of test 94 may lead to step 75 to announce all of the sectors again.

During off-peak, "S" may represent individual floors, step 76 may announce all individual floors and test 83 may respond to an elevator being assigned to the floor selected by the button interrupt at test 82.

Optionally, in a parallel processing computer, there may be several routines such as FIG. 5, and a rotating selection of them, so that additional passengers may select destination floor sectors while one or more passengers are waiting for their cars to be assigned and/or to be dispatched.

Figure 6:
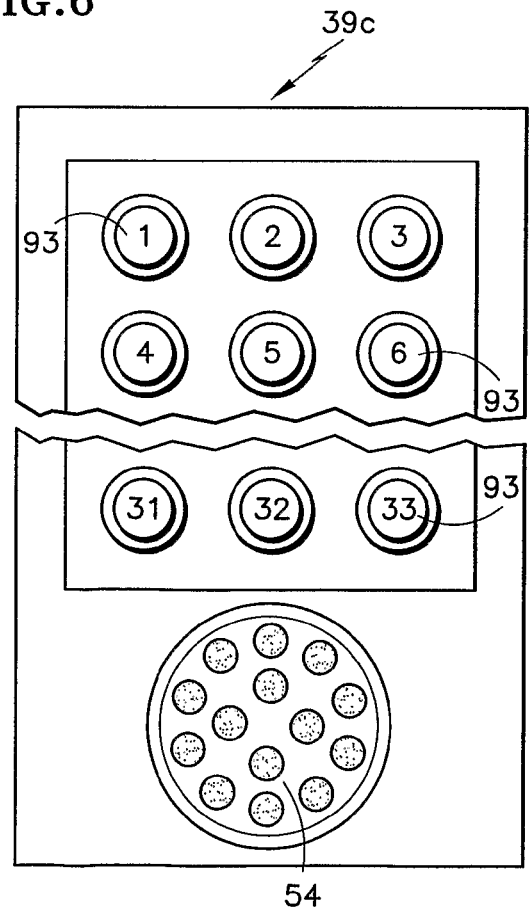
FIG. 6 is a front elevation view of a third embodiment of an elevator floor selection station of the invention.
Figure 7:
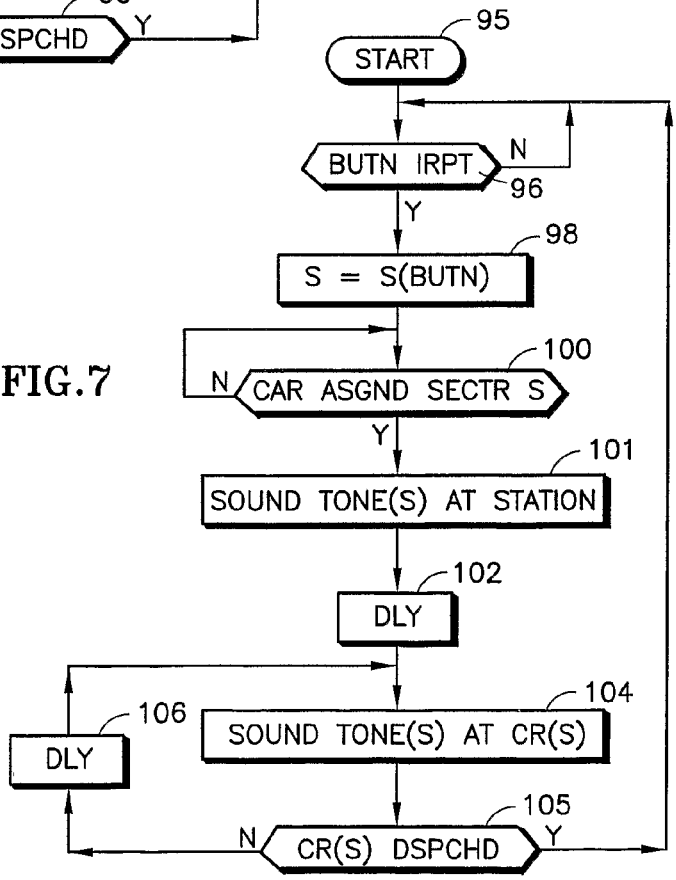
FIG. 7 is a simplified flow chart of functions which may be performed in utilization of the embodiment of FIG. 6.

A third embodiment of the invention, illustrated in FIG. 6, is a station 39*c* having a button 93 with a Braille indication for each floor in the building. Referring to FIG. 7, a routine indicative of functions suitable for the embodiment of FIG. 6 starts at a point 95 and a first test 96 waits for a button interrupt. When a button is pressed, a step 98 causes a sector indicator S to be set to the sector to which the floor related to the pressed button is assigned.

Then a test 100 determines if a car has been assigned to the sector of the desired floor, or not. When it has, a step 101 causes the tone of the car assigned to sector S to be sounded at the station, through the speaker 54. After a short delay at step 102, a step 104 will cause the tone of the car assigned to sector S to be sounded at the car assigned to sector S, through one of the speakers 32*a*-35*a* in FIG. 1.

A test 105 determines if the car assigned to sector S has been dispatched or not. As long as it has not, after a delay 106, the sounding of tone S at the car assigned to S will be repeated at step 104. When the car assigned to sector S has been dispatched, an affirmative result of test 105 causes the routine to revert to the test 96 to await another button interrupt.

At times other than rush hour up peak, step 98 in FIG. 7 may recognize "sector S" as being the floor of the interrupting button, so that the call will be serviced individually, rather than in a group of contiguous floors, as is conventional during off-peak.

In the foregoing embodiments shown in FIGS. 3, 5 and 7, steps (63, 64; 85, 87; and 101, 104; respectively) cause the tone (sound) of the desired sector, S, to be sounded. However, the invention may be practiced by permanently assigning each tone to a corresponding car and by sounding the tone permanently assigned to that car which is to respond to the passenger's selection. Thus, the foregoing steps should be understood to mean "sound tone of sector (S) or the car assigned to sector (S)".

The invention claimed is:

1. An elevator system, comprising:

a group of elevators (26-29) serving a selected plurality of floors of a building, which may be all or less than all of the floors of the building, from a plurality of corresponding elevator lobbies around which the elevators are disposed;

characterized by:

an elevator identifier disposed adjacent each elevator of the group on each floor, said elevator identifiers each emitting a unique sound;

at least one floor selection station (39*a*), on at least a main lobby floor at one or more positions which may be at or near an entrance to an elevator lobby, or within an elevator lobby, each having a button (70);

and means responsive to operation of one of said button a first time to begin verbally announcing, in sequence, choices selected from (a) individual destination floors and (b) groups of related floors, and responsive to operation of said one button a second time to identify as said choice the last announced (i) floor or (ii) group of related floors, wherein: said means announces groups of related floors during up-peak and individual floors during off-peak and for determining that one of said elevators has been assigned to respond to one or more floors identified as said choice, and to thereafter cause a sound uniquely identified with said choice to be emitted (i) at said station and (ii) at the one of said elevator identifiers, on the same floor as said station, adjacent to said one of said elevators assigned to serve said one or more floors identified as said choice.

2. A system according to claim 1 wherein: said sound comprises one or more tones.

3. A system according to claim 1 wherein: each said sound is permanently assigned to a corresponding elevator.

4. A system according to claim 1 wherein: each said sound is permanently assisting to one of said groups of floors.

* * * * *